US009346603B2

(12) United States Patent
De Busser

(10) Patent No.: US 9,346,603 B2
(45) Date of Patent: May 24, 2016

(54) BOIL-IN-BAG POUCH

(75) Inventor: Ives De Busser, Olen (BE)

(73) Assignee: Mars, Incorporated, McLean, VA (US)

( * ) Notice: Subject to any disclaimer, the term of this patent is extended or adjusted under 35 U.S.C. 154(b) by 702 days.

(21) Appl. No.: 13/516,392

(22) PCT Filed: Dec. 17, 2010

(86) PCT No.: PCT/IB2010/003419

§ 371 (c)(1),
(2), (4) Date: Sep. 4, 2012

(87) PCT Pub. No.: WO2011/073800

PCT Pub. Date: Jun. 23, 2011

(65) Prior Publication Data

US 2012/0328745 A1 Dec. 27, 2012

(30) Foreign Application Priority Data

Dec. 18, 2009 (GB) ..... 0922093.0

(51) Int. Cl.
*B65D 81/00* (2006.01)
*B65D 81/34* (2006.01)
*B65D 75/58* (2006.01)

(52) U.S. Cl.
CPC ..... *B65D 81/3415* (2013.01); *B65D 75/5805* (2013.01); *B65D 2581/3422* (2013.01)

(58) Field of Classification Search
CPC ..... B65D 81/3415; B65D 75/5805; B65D 75/5816; B65D 2581/3422; B65D 75/008; A47J 27/18; A47J 36/24
USPC ..... 383/102, 117, 207, 209, 100, 120, 104
See application file for complete search history.

(56) References Cited

U.S. PATENT DOCUMENTS 2,103,389 A * 12/1937 Salfisberg ..... 222/107
2,145,941 A * 2/1939 Maxfield ..... 53/433
2,969,292 A * 1/1961 Heller ..... 426/113
3,081,174 A * 3/1963 Gay ..... 426/113

(Continued)

FOREIGN PATENT DOCUMENTS

DE 8901806 U1 4/1989
DE 20320061 U1 3/2004

(Continued)

*Primary Examiner* — Nathan J Newhouse
*Assistant Examiner* — Peter Helvey
(74) *Attorney, Agent, or Firm* — Mars, Incorporated; Laura C. DiLorenzo

(57) ABSTRACT

A boil-in-bag pouch (1,50) containing a foodstuff (30), wherein said pouch is in the form of an enclosed body (4,52) having a front face (8,78), a back face (7,80), a top end, a bottom end, and first and second sides (9,10,54,56) extending between said top and bottom ends, said pouch comprising: a single sheet of flexible sheet material having first and second opposed edges, wherein said sheet is folded along said first side (10,54) and said second side (9,56) to define said front and back faces, wherein opposed edges of said sheet are bonded by a longitudinal seal (2,70) extending from said top end to said bottom end of said pouch; a top transverse seal bonding said front and back faces together proximate to said top end; a bottom transverse seal bonding said front and back faces together proximate to said bottom end; and wherein said sheet is folded form a pleat extending from the bottom transverse seal to the top transverse seal along only one of said sides (10,54) of said body (4,52).

10 Claims, 7 Drawing Sheets

(56) References Cited

U.S. PATENT DOCUMENTS

| | | | | | |
|---|---|---|---|---|---|
| 3,380,646 | A | | 4/1968 | Doyen et al. | |
| 3,407,077 | A | * | 10/1968 | Helin | 426/110 |
| 3,615,712 | A | * | 10/1971 | Keller | 426/113 |
| 3,819,089 | A | * | 6/1974 | Scales | 222/95 |
| 3,873,735 | A | * | 3/1975 | Chalin et al. | 426/87 |
| 5,044,777 | A | * | 9/1991 | Watkins et al. | 383/100 |
| 5,375,930 | A | * | 12/1994 | Tani | B65D 33/2533 383/104 |
| 5,613,779 | A | * | 3/1997 | Niwa | 383/201 |
| 5,863,585 | A | * | 1/1999 | Sjoberg | 426/389 |
| 5,914,142 | A | * | 6/1999 | Zartner | 426/113 |
| 6,153,232 | A | * | 11/2000 | Holten et al. | 426/79 |
| 6,342,258 | B1 | * | 1/2002 | Berings et al. | 426/79 |
| 6,659,645 | B1 | * | 12/2003 | Schulz | B65D 75/5855 383/104 |
| 7,055,720 | B1 | * | 6/2006 | Pritchard | B65D 33/2508 222/107 |
| 7,207,717 | B2 | * | 4/2007 | Steele | B31B 19/84 383/10 |
| 7,331,716 | B2 | * | 2/2008 | Nakano et al. | 383/203 |
| 7,594,582 | B2 | * | 9/2009 | Sus et al. | 220/9.4 |
| 8,268,376 | B2 | * | 9/2012 | Sus et al. | 426/418 |
| 8,684,600 | B2 | * | 4/2014 | Sus et al. | 383/16 |
| 2003/0185469 | A1 | * | 10/2003 | Knoerzer | B65D 75/008 383/104 |
| 2006/0032875 | A1 | * | 2/2006 | Patterson | A45C 9/00 224/153 |
| 2006/0045390 | A1 | * | 3/2006 | Sill | B65D 31/10 383/6 |
| 2006/0120631 | A1 | * | 6/2006 | Tang | B65D 33/2508 383/100 |
| 2007/0081745 | A1 | * | 4/2007 | Tetenborg et al. | 383/207 |
| 2007/0248292 | A1 | * | 10/2007 | Wolf | B65D 33/007 383/120 |
| 2008/0107781 | A1 | * | 5/2008 | Carroll | B65D 31/12 426/128 |
| 2008/0247683 | A1 | | 10/2008 | Schmal et al. | |
| 2010/0016825 | A1 | * | 1/2010 | Graf | A61M 1/1656 604/408 |
| 2014/0248005 | A1 | * | 9/2014 | David | B65D 75/008 383/104 |

FOREIGN PATENT DOCUMENTS

| | | | | |
|---|---|---|---|---|
| DE | 202005004821 | U1 | | 7/2006 |
| EP | 0947444 | A1 | | 10/1999 |
| LU | 44054 | | * | 9/1963 |
| LU | 44054 | A1 | | 9/1963 |

* cited by examiner

BOIL-IN-BAG POUCH

The present application claims priority of GB0922093.0 filed on 18 Dec. 2009, the entire content of which is expressly incorporated herein by reference.

The present invention relates to compact boil-in-bag pouches that are easy to open and easy to handle. The invention also relates to methods of making such pouches.

The term "boil-in-bag pouches" refers to packages containing a food material that is intended to be cooked or reheated inside the package, for example by immersion of the package in hot water or by microwave heating. Boil-in-bag pouches for food products are by now well known in the food packaging art. The pouches are generally formed from flexible thermoplastic sheet materials and may be water-permeable or water-impermeable depending on the food product concerned. Water-permeable boil-in-bag pouches are used where rehydration of a food product inside the package is required, e.g. boil-in-bag rice or pasta. Water-permeable boil-in-bag pouches (sachets) are usually formed from perforated or reticulated thermoplastic film on conventional forming, filling and sealing equipment.

A difficulty with boil-in-bag packaging for use in the home is that the packaging must normally be opened while the contents are still hot. This entails awkward manipulation of the hot package with consequent risk of spillage and/or scalding of the person manipulating the package. Moreover, an additional utensil, such as a knife or scissors, may be needed to open the package.

GB-A-2117350 describes a water permeable boil-in-bag pouch suitable for cooking rice. The pouch is manufactured from a single, overlapped web of a perforated thermoplastic film. The pouch has two parallel, spaced-apart transverse seals at the top of the pouch, and another two parallel, spaced-apart transverse seals at the bottom of the pouch. The top and/or the bottom of the pouch is provided with a horizontal aperture of at least 1.9 cm in length within the region of the film overlap and between the two transverse seals. The horizontal aperture provides a fork slot that allows the boil-in-bag pouch to be lifted from the boiling water in which it has been cooked without tearing the thermoplastic film.

EP-A-0478812 describes an easy-to-open package for food products useful for boil-in-bag or microwave packaging. The package comprises a sealed, flexible package with a thermoformed bottom web and a top web of mono-oriented material. A V-shaped precut is formed in the top web, whereby pulling on the precut results in tearing of the top web along the direction of orientation of the mono-oriented material, thereby opening the container. The precut is covered by an adhesive membrane patch which prevents leakage through the precut prior to opening the container, and which also operates as a starting pull tab for the opening. EP-A-0499647 describes a similar package to that described in EP-A-0478812, except that the pull tab is formed as a precut in the upper one of two layers making up one part of the top web. This arrangement allows the adhesive membrane patch of EP-A-0478812 to be dispensed with. However, such packages are somewhat complex to manufacture and require the use of at least one web of mono-oriented plastic material.

GB-A-2283007 discloses a boil-in-bag pouch provided with two top and one bottom transverse seals. Between the two top transverse seals there is a fork slot that allows the boil-in-bag pouch to be lifted from the boiling water. Two longitudinal lines of weakness, eg. perforations, on opposite sides of the pouch define a tear strip in the pouch to assist opening of the pouch. The pouch also comprises a transverse line of weakness from the edge of the pouch to the lines of weakness to initiate tearing of the tear strip. Similar boil-in-bag pouches are described in DE-A-19716141 and DE-U-7540166.

EP-A-0947444 and GB-A-2335910 describe a water-permeable boil-in-bag pouch comprising top and bottom transverse seals, wherein the bottom transverse seal extends obliquely downwardly from at least one side edge of the pouch to define a bag-like or funnel-like bottom to the pouch, thereby improving drainage of water from within the pouch. The oblique transverse seals also define cool-touch corners at the bottom of the pouch that assist handling of the pouch when the contents are hot. These pouches are currently used commercially for packaging Uncle Ben's® boil-in-bag rice.

LU-A-44054 describes boil in bag pouches for cooking noodles. The pouches have pleated folds in each of the side edges, and a handle inserted into one of the side edges. The use of pleated edges is said to prevent the noodles from sticking together during cooking. However, the pouches of LU-A-44054 must be opened by tearing along the central axis of the pouch, which would make opening and emptying of the pouch difficult and messy.

JP-A-9290870 describes a rice cooking bag having a pleated fold along one edge. The alleged advantage is that less cooked rice is trapped inside the bag, and the rice can be removed from the bag more easily. The rice cooking bag is made from a nonwoven fabric that is sealed along three edges with a pleat in the bottom edge and the top edge left unsealed for filling and emptying of the rice. The structure of this rice bag, which is apparently intended for multiple use, does not lend itself to high-speed production and filling in a continuous manufacturing process.

Nevertheless, a need remains for improved boil-in-bag pouches that have a more compact shape and/or are easy to handle when hot and/or provide improved drainage of cooking water and/or are easier to open when hot and/or are easier to empty completely.

The present invention provides a boil-in-bag pouch containing a foodstuff, wherein said pouch is in the form of an enclosed body having a front face, a back face, a top end, a bottom end, and first and second sides extending between said top and bottom ends, said pouch comprising: a single sheet of flexible sheet material having first and second opposed edges, wherein said sheet is folded along said first side and said second side to define said front and back faces, wherein opposed edges of said sheet are bonded by a longitudinal seal extending from said top end to said bottom end of said pouch; a top transverse seal bonding said front and back faces together proximate to said top end; a bottom transverse seal bonding said front and back faces together proximate to said bottom end; and wherein said sheet is folded form a pleat extending from the bottom transverse seal to the top transverse seal along only one of said sides of said body.

The dimensions of the pouch are suitably adapted to contain a single serving, two servings, or multiple servings of the food product. For example the pouch may have a length between the ends of from about 10 cm to about 20 cm and a width between the side edges of from about 5 cm to about 15 cm.

The terms top and bottom and related expressions herein are relative terms, referring to first and second ends of the pouch respectively. It will be seen that, in use, the second side of the pouch is actually held lowermost.

The pouches of the present invention are characterized by the presence of a pleat extending longitudinally substantially from the top transverse seal to the bottom transverse seal. The term "pleat" is used in its usual sense to denote two or more parallel strips of the sheet material folded inwardly, i.e. such that the material of the strips is folded back towards the adjoining sheet material. The pleats suitably have a W-profile (accordion pleat) when viewed in transverse cross-section, but more complex profiles such as a dovetail pleat (reversed pleat) are also possible.

The provision of a pleat in one side of the pouch body allows the pouch to expand to a more spherical shape, thereby reducing the size (in plan view) of the pouch for a given amount of foodstuff being packaged. The pleat also assists handling and emptying of the pouch, as explained further below. Also, the pleat improves drainage of cooking water from inside the pouch, as explained further below.

The pouch body according to this aspect of the invention is formed from a single tubular sheet of material that is closed by the top and bottom transverse seals. The tubular body may is formed from a flat sheet of the material by wrapping the sheet around a suitably shaped mandrel and bonding opposed edges of the sheet longitudinally with a lap seal or a fin seal, in similar fashion to the well known form-fill-seal processes.

The pleat is formed in only one of the side edges. The opposite side edge is suitably a simple fold in the sheet material. That is to say, the first edge has a simple U or V cross-section The resulting pouch thus resembles the well-known "stand-up" pouches used for various packaging applications, but with the advantage that the pouch of the present invention is formed from a single sheet of material by simple modification of existing form-fill-seal machines as explained further below. The configuration of the pouch with a pleat in only one edge provides the advantage of easy opening and emptying of the pouch by tearing along a line proximate to the first edge of the pouch, as explained further below, and also makes it easier to provide a handle.

The pleat may be formed by folding the tubular body inwardly along the said one edge of the body so that it forms a W profile along the edge when the pouch is viewed in transverse cross section. In these embodiments, the pleat comprises a first strip of the sheet material folded inwardly towards the front face of the pouch along said only one side of the pouch and a second strip of the material folded inwardly towards the back face of the pouch along said only one side of the pouch, said first and second strips meeting along a fold line located internally of said front and back faces, and respective top and bottom ends of said first and second strips being bonded in face to face relationship with said front and back faces, respectively, at said top and bottom transverse seals.

Suitably, the width of said folded regions, corresponding to the maximum depth of the pleat formed in the said only one side of the pouch, is from about 10% to about 50% of the width of the pouch, for example about 2 cm to about 6 cm. Suitably, the widths of the folded strips are substantially equal.

In certain embodiments, the top and bottom transverse seals are substantially linear seals, and suitably they are substantially parallel. The pouch is formed generally with front and back faces and with side edges extending between the ends of the top and bottom transverse seals. Suitably, the side edges are substantially parallel. Suitably, the side edges are substantially perpendicular to the top and bottom ends, so that the pouch has a substantially rectangular shape in plan view.

The various seals forming the pouch are suitably formed by melt-bonding of the sheet material, for example heat seals, ultrasonic seals or impulse seals, but in some embodiments the seals could even be formed by adhesive bonding or stitching. The seals may be intermittent, broken, interrupted or discontinuous, provided that any gaps present in the seals are not so large as to allow the contents of the pouch to escape.

Suitably, the transverse seals define end flaps on the pouch, that is to say flat sheet regions at the end of the pouch from which the contents of the pouch are substantially excluded. These end flaps can be used for handling the pouch when the pouch is hot. Suitably, the end flaps have a substantially uniform width (measured in the longitudinal direction of the pouch). Suitably the minimum width of the end flaps is from about 1 cm to about 4 cm, for example from about 1.5 cm to about 3 cm, typically about 2 cm. The end flaps may be formed by broad seals in the ends of the tube, or they may be formed by two or more, narrower, longitudinally spaced-apart lines of sealing in one or both ends of the pouch. In certain embodiments, the pouch may comprise one or more apertures in one or both end flaps (i.e. fork slots) for inserting a utensil to lift the pouch from a cooking liquid. Typical fork slots are described, for example, in GB-A-2117350 and GB-A-2283007. However, in preferred embodiments, such as those having a handle as described further below, the fork slots are not needed and not present.

Suitably, the pouch further comprises one or more diagonal lines of bonding between layers of the sheet material, wherein the diagonal lines of bonding extend obliquely from an intermediate region of the top and/or bottom of the pouch to an edge of the pouch, wherein said diagonal lines of bonding define two corners, respectively adjoining the top and bottom of said only one side edge of the pouch, from which the contents of the pouch are substantially excluded, These further lines of bonding are used to define one or more corners of the pouch from which the contents of the pouch are substantially excluded. These "cool-touch corners" assist handling of the pouch when the contents are hot. They also can define a funnel shape in the second side of the pouch that assists drainage of water from permeable pouches used to cook rehydratable products such as rice. They also assist emptying of the pouch, since less of the product is trapped in corners of the pouch. These advantages are explained in more detail in EP-A-0947444.

In these embodiments, the diagonal lines of bonding may intersect the edge of the pouch at an angle of from 20° to 70°, more suitably 30° to 60°, and most suitably about 45° to the longitudinal axis of the pouch. Suitably, the further lines of bonding define two cool-touch corners, respectively at the top and bottom of one side of the pouch, thereby defining an overall funnel-like shape to the pouch on that side for optimum drainage from that side and optimum emptying from the opposite side. Suitably, the cool-touch corners are defined on the side of the pouch proximate to the pleat, so that drainage of excess cooking liquid from the pouch takes place through the pleat and emptying of the pouch takes place through the side (edge) of the pouch opposite the pleat. Suitably, the dimensions of the cool-touch corners are about 2-5 cm on each side.

For example, in the embodiments of the present invention having a W-pleat (gusset pleat) formed by first and second strips of the material folded inwardly from the second edge of the pouch, the pouch suitably further comprises four diagonal sealing bonds extending as follows: (1) at the top corner of the pleat, a first diagonal sealing bond between the first strip of the pleat and the front face and a second diagonal sealing bond between the second portion of the pleat and the back face of the body, and (2) at the bottom corner of the pleat, a third diagonal sealing bond between the first strip of the pleat and the front face and a fourth diagonal sealing bond between the second portion of the pleat and the back face of the body. These diagonal heat sealing bonds exclude the contents of the pouch from the corners of the pleat, and define a funnel shape for drainage of excess cooking water from the pouch through the pleat side of the pouch. Suitably, there are no diagonal sealing bonds formed between the first strip and the second strip, since such bonding would reduce the area available for drainage from the second side of the pouch.

Suitably, each of said top and bottom ends comprises: a first transverse seal between said front and back sheets extending substantially completely across said end; and a second transverse seal between said front and back sheets spaced inwardly from said first transverse seal and extending substantially parallel to said first seal from said first side to an intermediate position, where it joins to said diagonal lines of bonding but does not extend further parallel to said first transverse seal beyond said intermediate position.

The boil-in bag pouch may be opened by cutting or tearing, and may be provided with one or more tear starts such as nips in the top and/or bottom end or end flap of the pouch to assist opening. Suitably, the nip is a substantially triangular or trapezoidal cut-out extending downwardly from the top edge or upwardly from the bottom edge of the boil-in-bag pouch. The nip may be formed by cutting a continuous stream of pouches, such as are formed on a vertical form/fill/seal machine, using a suitably shaped knife or die cutter.

In certain embodiments, the boil-in-bag pouch may be provided with one or more longitudinal lines of weakness defining a tear strip in the pouch. Suitably, the lines of weakness extend from the top transverse seal to the bottom transverse seal. For example, the boil-in-bag pouch may have two pairs of said longitudinal lines of weakness defining two tear strips. Suitably, the lines of weakness of each said pair extend substantially parallel to each other, for example on opposite sides of the pouch adjacent to a longitudinal edge of the pouch.

The tear start(s) and/or the lines of weakness (where present) are located proximate to the first side of the pouch body. By "proximate" is generally meant that the tear start(s) or lines of weakness are located in the portion of the pouch intermediate the longitudinal median line of the pouch and the first side of the pouch. Suitably, the tear start(s) or lines of weakness are located from about 5 mm to about 30 mm from the said edge opposite the pleated edge, for example about 10 mm to about 20 mm. In this way, drainage of excess cooking water suitably takes place through the pleat, with the pouch held so that the pleated side is lowermost, or standing on the pleated side on a drainage surface. The pouch can then opened while it is standing up, supported by the pleated side, using the tear start or tear lines, thereby minimising the risk of scalding the user or spilling the contents during opening. The pouch is then held by the end flaps and inverted to empty the contents.

In certain embodiments, the pouch may be provided with a handle attached to the pouch. For example, the handle may be formed by a strip of sheet material extending between the top and bottom transverse seals and bonded to the pouch at the top and bottom transverse seals. Suitably, the handle is applied proximate to the first side of the pouch opposite the pleated side. By "proximate" is generally meant that the handle is attached to the portion of the pouch intermediate the longitudinal median line of the pouch and the side of the pouch opposite the pleated side. Suitably, the handle attachments are located from about 0 to about 30 mm from the said side opposite the pleated side, for example about 0 mm to about 20 mm. Thus, the handle can be used to lower the pouch into hot water for cooking the contents of the pouch. After cooking, the pouch can conveniently be lifted by the handle to remove it from the cooking water, and held by the handle such that the pleated side of the pouch is lowermost for drainage of water from the pouch through the pleat, followed by opening of the pouch as described above.

In these embodiments, suitably the longitudinal seal between opposed edges of said sheet material is a lap seal whereby a longitudinal flap of said sheet material extends on the outside of the pouch body from the top to the bottom of said body and bonded to said front and back faces at said top and bottom transverse seals, and a longitudinal cut extends along at least a portion of said flap whereby said handle is formed by a distal portion of said flap.

Suitably, the pouch body is formed from water-permeable sheet material, and the body contains a rehydratable foodstuff selected from the group consisting of cereal grains, pasta and beans.

Typically, the pouch material comprises or consists essentially of a thermoplastic film, such as a polyethylene or polypropylene film, and has a base sheet thickness of less than about 60 μm, suitably 10 to 50 μm, for example 20 to 40 μm and most suitably about 30 μm. In certain embodiments the sheet material may be a laminate having a heat-sealable outer layer. Suitably, the pouch is substantially translucent, and more preferably it is substantially transparent. Suitably, the pouch is formed from foraminous material, such as a perforated or reticulated web. This provides for maximum water permeability of the pouch, which is desirable for cooking rehydratable foodstuffs. The pouch material may also be embossed.

The pouch according to the present invention suitably contains a foodstuff. The amount of foodstuff is suitably from about 50 g to about 500 g, typically about 100 g to about 250 g. Suitably, the pouch contains a rehydratable foodstuff such as rice, other cereal grains, pasta, or beans. In certain embodiments the pouch contains rice grains. Where the pouch contains a rehydratable foodstuff, the sheet material of the pouch is normally a water-permeable sheet material. The term "rehydratable foodstuff" refers to a foodstuff having a moisture content less than that normally required for consumption, typically less than about 20% water by weight. Normally the rehydratable foodstuff has a moisture content sufficiently low for the rehydratable foodstuff to be shelf stable at ambient temperature when stored in the permeable pouch.

The pouch (optionally excluding any attached handle) may be formed from a single web or tube of film material, which is preferably a thermoplastic film material. Suitably, a single web of film material is overlapped and bonded by a longitudinal seal (lap or fin seal), for example by form/fill/seal equipment to form the body of the pouch. The transverse bottom seal (with diagonal bonding lines where appropriate) is formed, the pouch is filled, and then the transverse top seal (with diagonal bonding lines where appropriate) is formed. The pleat in these embodiments is suitably formed by folding a region of the film material inwardly during the step of forming the tubular body, for example by folding the film material around a suitably shaped mandrel, whereby the ends of the pleat are bonded into the top and bottom seals. In other embodiments the pleat is formed by a pleating plate that is positioned between the sealing jaws at one end of the sealing jaws. The pleating plate may be moved out of the jaws, for example in a reciprocating movement, in between sealing operations, in order not to interfere with the free running of the tube in the FFS machine.

The boil-in-bag pouch according to the present invention may be formed from a continuous web of thermoplastic material using a modification of vertical form/fill/seal techniques well known to those skilled in the art and described, for example, in U.S. Pat. No. 2,145,941 and in the references cited above as background to the present invention.

Accordingly, in a further aspect the present invention provides a method of forming a boil-in-bag pouch comprising the steps of: wrapping a flat sheet of material around a former and bonding opposed edges of the sheet to form a tubular body of said material; forming a transverse seal in the bottom of said tubular body while indenting one side only of said body to form a pleat in said side; filling said body with a foodstuff; and forming a top transverse seal in the top of said body while indenting said one side only of said body to form said pleat in said edge.

Suitably the said bonding forms a lap seal having a flap of said sheet material extending from one face of the pouch, and the method further comprises cutting along said flap to form a handle.

In certain embodiments, the pleat is suitably formed by folding the pleat in the tubular body, prior to forming the top and bottom end seals by bonding the front and back faces together with the first and second inwardly-folded strips together at the ends of the pouch to fix the pleat in the pouch.

The lines of weakness (where present) can be provided in the continuous web of thermoplastic material before it is formed into the pouch, for example by use of a pre-perforated film. Alternatively, the equipment is modified to provide the lines of weakness. For example, in certain embodiments lines of perforations are provided by means of a rotating perforation knife forming a continuous line of perforations extending longitudinally along the continuous web of thermoplastic material. Where present, the oblique transverse seals can be provided by means of a suitably shaped impulse sealing or heat sealing jaw or a plurality of sealing jaws in one or more heat sealing steps before filling of the pouch, as described in more detail in EP-A-0947444.

The handle may be applied by relatively simple modification of convention form-fill-seal equipment. In certain embodiments, a separate strip of handle material is run through the FFS equipment in parallel with the sheet material used to form the body. The handle material is bonded to the body and cut to the length of the body in the sealing and cutting steps that are used to form the body. In other embodiments, the body is formed with a longitudinal lap seal in the FFS machine, such that the lap portion is unusually wide, for example from about 20 mm to about 30 mm wide. The handle is formed by cutting longitudinally through the lap about 5 mm to about 20 mm from the edge of the lap between the top and bottom end seals. The resulting handle is thereby formed from the same initial sheet as the pouch body, which removes difficulties associated with separate attachment of a handle strip. The cutting along the lap portion is suitably done prior to formation of the transverse seals. It may be done just before formation of the lap seal, or after formation of the lap seal.

The method of the invention may be used to make a pouch according to the present invention according to any of the embodiments described herein.

In a further aspect the present invention provides a boil-in-bag pouch containing a foodstuff, said pouch having a body having front and back faces formed from a single sheet of flexible sheet material, a top transverse seal, a bottom transverse seal and characterized in that a region of the body is folded to form a pleat extending from the bottom transverse seal to the top transverse seal along one side only of said body.

It will be appreciated that any feature that is described herein in relation to any one aspect of the invention may also be found in a boil-in-bag pouch or method according to any other aspect of the invention as herein described.

Specific embodiments of the invention will now be described further, by way of example, with reference to the accompanying drawings, in which.

Figure 1:
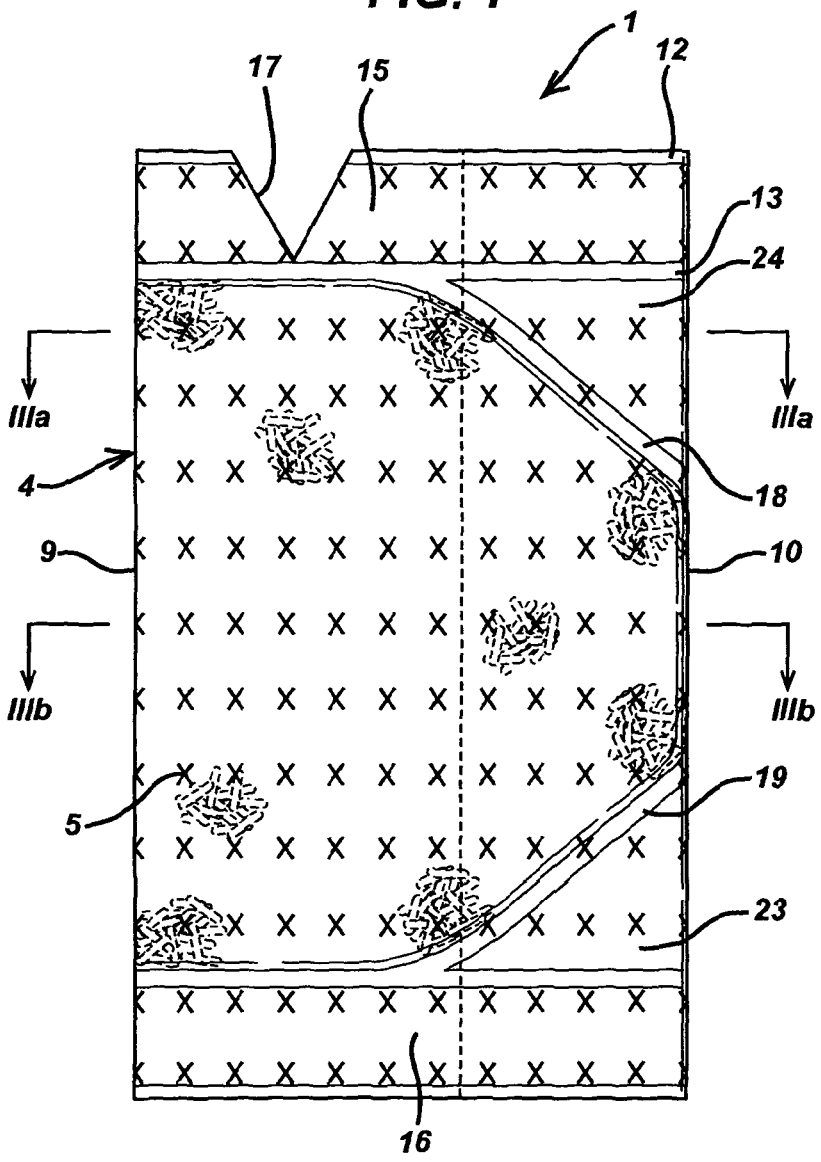
FIG. 1 shows a front elevation view of a boil-in-bag pouch according to the present invention.
Figure 2:
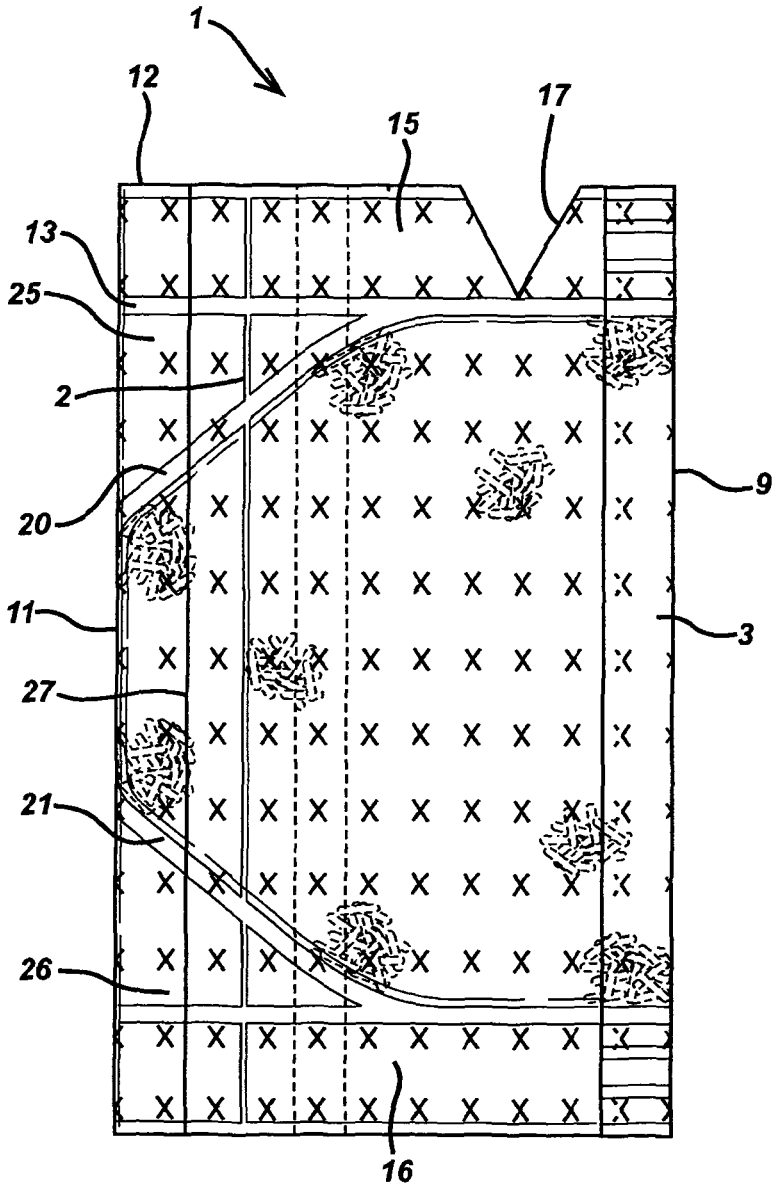
FIG. 2 shows a back elevation view of the pouch of FIG. 1.
Figure 3A:
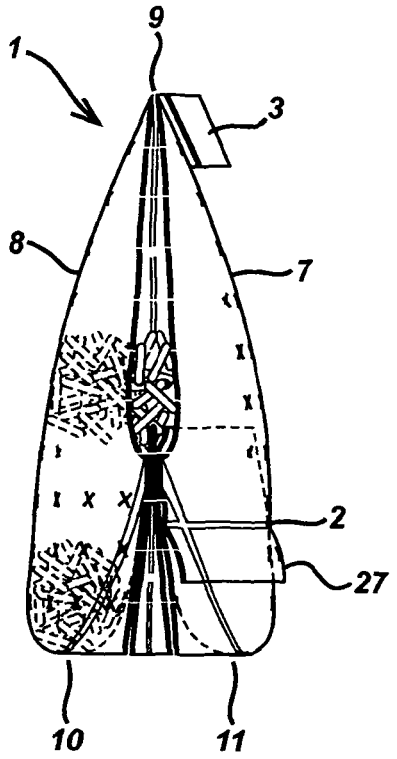
Figure 3B:
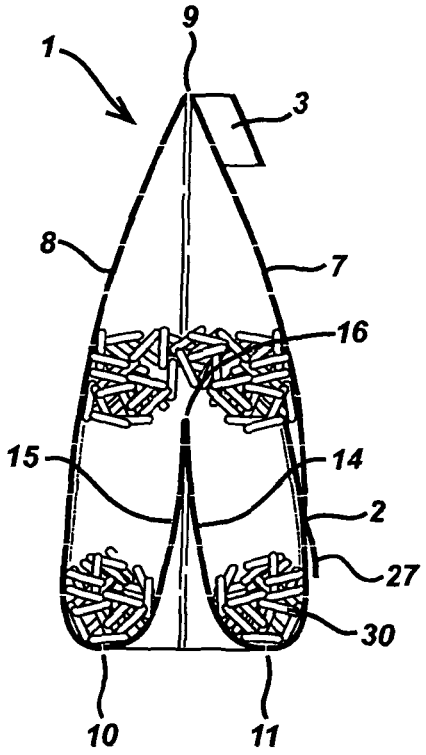
Figure 4A:
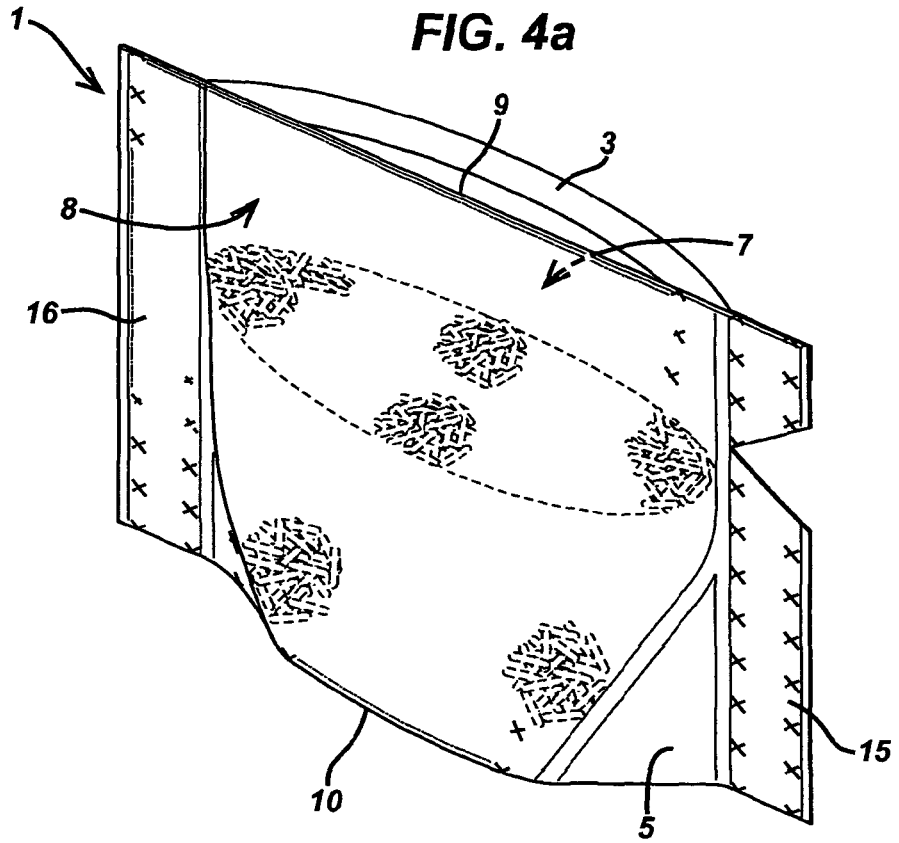
Figure 4B:
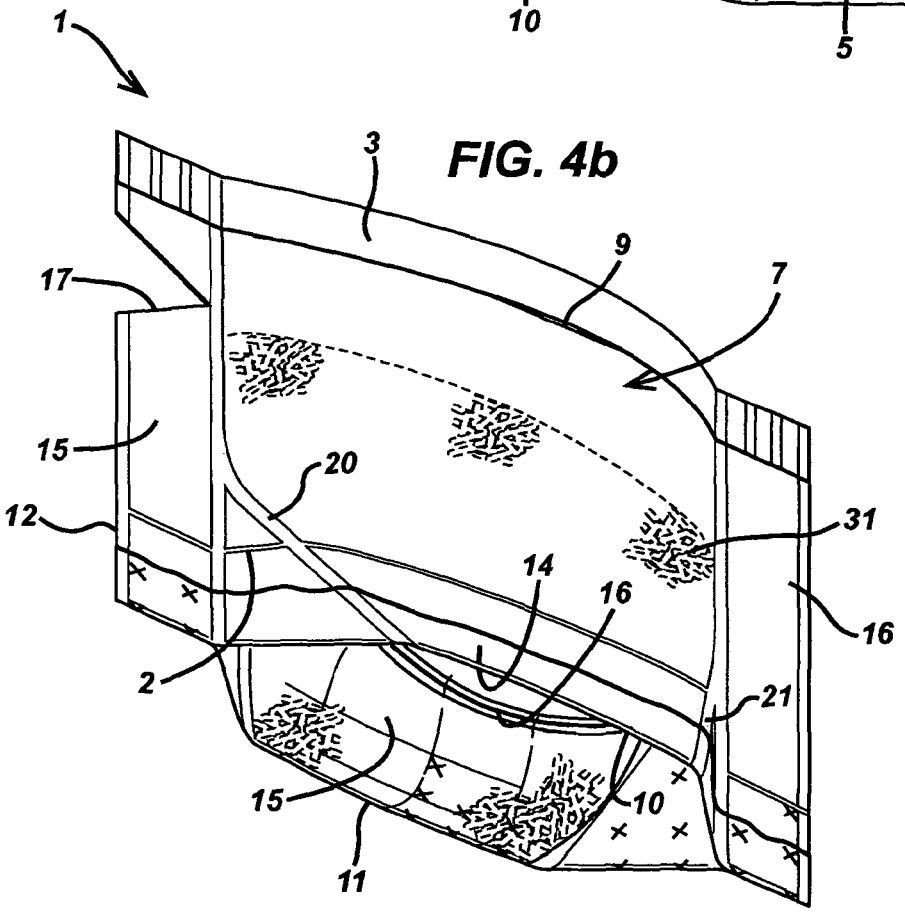

FIG. 3*a* shows a first transverse cross-section through the pouch of FIG. 1, along IIIa-IIIa;

FIG. 3*b* shows a second transverse cross-section through the pouch of FIG. 1 along IIIb-IIIb;

FIG. 4*a* shows a perspective view from above of the pouch of FIG. 1 with the pouch oriented as it would be for drainage and opening after cooking;

FIG. 4*b* shows a perspective view from below of the pouch of FIG. 1 with the pouch oriented as in FIG. 4*a;*

Figure 5:
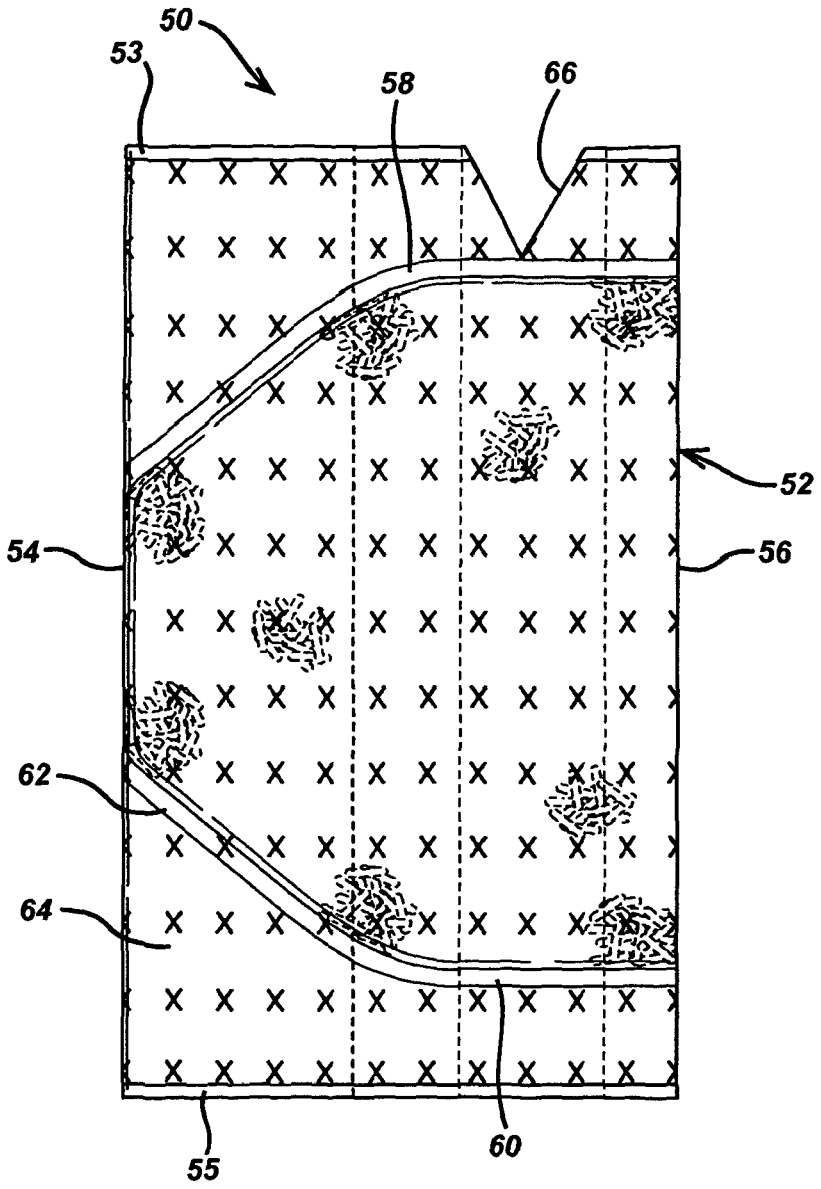
Figure 6:
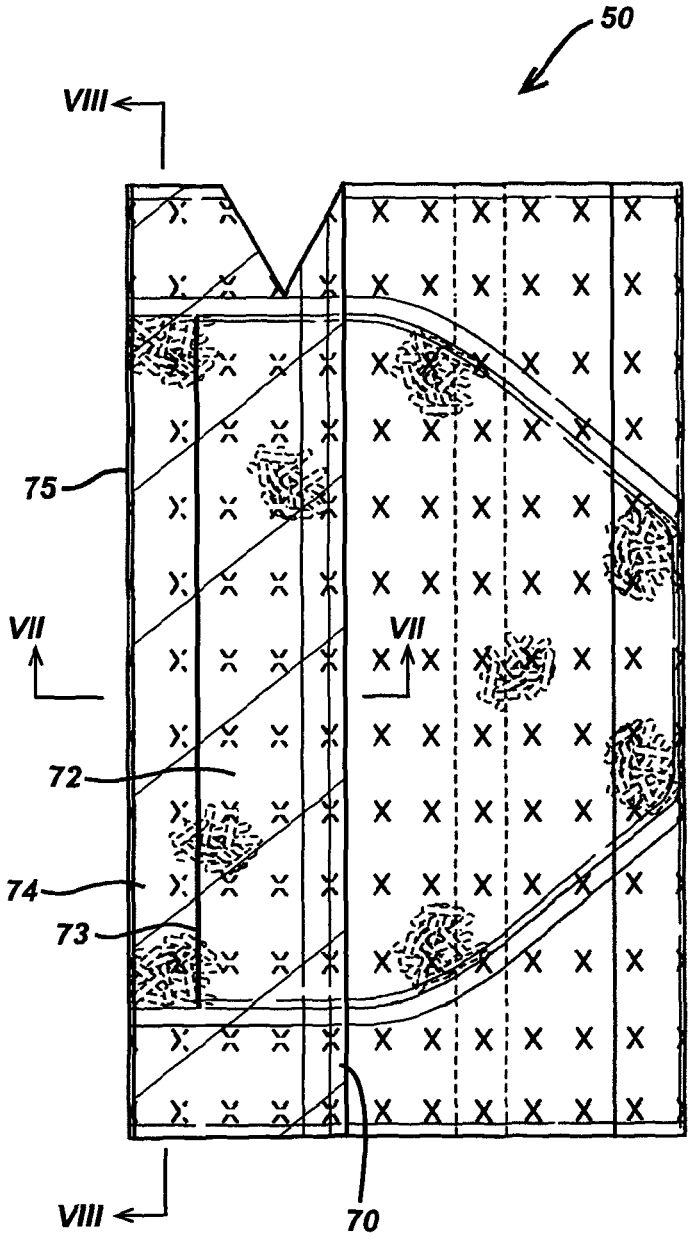
Figure 7:
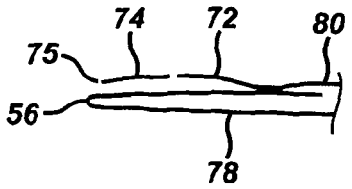
Figure 8:
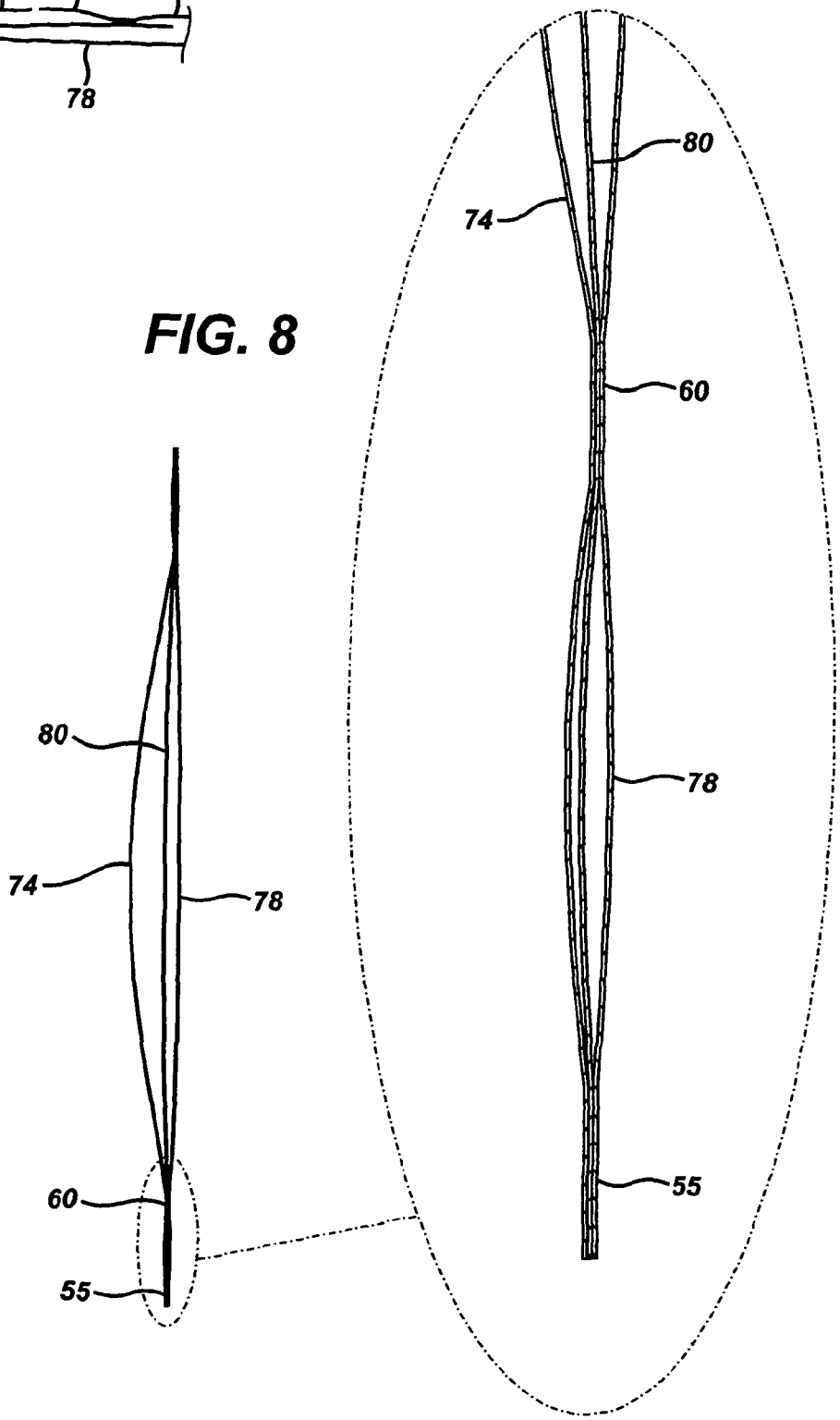

FIG. 5 shows a front elevation view of a second embodiment of the boil-in-bag pouch according to the present invention;

FIG. 6 shows a back elevation view of the pouch of FIG. 5;

FIG. 7 shows a partial transverse cross-section through the pouch of FIG. 5, along VII-VII; and FIG. 8 shows a longitudinal cross-section through the pouch of FIG. 5 along VIII-VIII, with a further enlarged view of an end sealing region thereof.

Referring to the drawings, the boil-in-bag pouch 1 comprises a tubular body 4 having heat-sealed ends. The body 4 is formed from a single web of a heat-sealable thermoplastic film material, which is a perforated polyethylene film. The film base sheet thickness is 34 μm. The film is water permeable by virtue of perforations 5. The perforations 5 are so-called "star punctures" formed on a 9 mm×9 mm square grid pattern by a calendering roller. The tubular body 4 of the pouch comprises a longitudinal heat seal 2 (lap seal) that extends up an overlapped region of the film extending along the back of the pouch to form the tubular body from a single sheet of material.

The boil-in-bag pouch 1 is provided with a handle 3 that is formed from a strip of the same sheet material, but without any perforations. The top and bottom ends of the handle 3 are heat-sealed to the top and bottom ends of the pouch. In other embodiments, the handle may be replaced or supplemented by a fork slot (not shown) in one or both of the end flaps.

The body 4 is substantially tubular, having front and back faces 7,8 and side edges 9, 10 by virtue of the substantially parallel top and bottom end seals. A distinctive feature of the pouch is that a pleat (gusset) is formed along one side edge 10 by folding the material of the pouch inwardly along the edge to form a W-profile in cross-section as shown in FIG. 3. The pleat comprises a first strip 14 of the sheet material that is folded back towards the front face 7 along fold 11 and a second strip 15 of the sheet material that is folded back towards the back face 8 of the body along fold 13, the first and second strips 14,15 meeting at fold 16 located internally of front and back faces 7,8. The width of the first and second portions 14,15 are substantially equal, said width in this embodiment (equal to the maximum depth of the pleat) being about 4 cm. The overall width of the pouch being about 10 cm and the overall length of the pouch between the top and bottom being about 16 cm. The pleat is fixed by the heat bonding the front and back faces together with the first and second portions in face-to-face relationship at the ends of the pouch.

The top and bottom ends of the pouch are sealed by means of transverse top and bottom heat seals. Each of these seals is formed of two, transverse horizontal heat sealed bonds (lines of sealing) 12,13 extending across the pouch. The bonds 12,13 are about 3 mm wide and are spaced apart by about 2 cm to define top and bottom end flaps 15,16 of the pouch, each flap having height about 2 cm. These flaps 15,16 can be grasped fairly comfortably, even when the contents of the pouch are hot. The top end flap 15 contains a V-shaped notch 17 spaced approximately 2 cm from the side edge opposite the pleated side edge. The notch 17 is intended to be used as a tear start to initiate opening of the pouch.

In addition to the transverse heat seals, the pouch further comprises diagonal heat sealing bonds 18,19,20,21 extending across corners of the pleat to bond, respectively, the first portion of the pleat to the front face (sealing bonds 18,19) and the second portion of the pleat to the back face of the body (sealing bonds 20,21). The diagonal heat sealing bonds do not bond the first portion of the pleat to the second portion of the pleat. These diagonal heat sealing bonds exclude the contents of the pouch from corners 23,24,25,26. This has the advantage that the corners 23,24,25,26 are relatively cool and can be used for handling of the pouch when the contents are hot. Moreover, food does not become trapped in the corners 23,24, 25,26 which assists emptying of the pouch. Furthermore, the corners 23,24,25,26 together with the pleat define a funnel shape that assists drainage of water from the pouch when it is lifted from the cooking water by handle 3 so that the pleated side is lowermost as shown in FIG. 4.

The pouch 1 contains parboiled, fully milled rice grains 30 dried to microbiological stability of 10-12 wt. % moisture.

In use, the rice in the pouch is cooked by immersing the pouch in boiling water for the appropriate cooking time. The pouch is then removed from the boiling water by inserting a fork or other utensil under the handle 3 and lifting. Excess water drains from the pouch through the pleated side, which together with the diagonal sealing bonds 18,19,20,21 defines a funnel shape for optimum, uniform drainage of the water. It is a further advantage of the pouches according to the invention that the pouch can stand up on a drainage surface without external support by resting on the gusset (pleat) side (i.e. with the pleated portions facing down), in similar fashion to conventional stand-up pouches. Thus, the pouch can be placed on a drainage surface to allow the excess water to drain from the pouch. This contrasts with existing boil-in-bag pouches, which must be supported by the user during drainage, and thereby the pouches according to the present invention can be drained for longer without tiring or scalding the user.

The pouch is opened by grasping the top end flap 15 above and below the notch 17 and by pulling across the notch 17 to tear the pouch open. This step too can be performed while the pouch is standing on a suitable surface thereby reducing the risk of spillage of the pouch contents, or of discomfort to the user. Once the pouch is open, the end flaps 16,17 can also be grasped to invert the pouch so that the cooked rice can be poured easily from the pouch. The provision of the diagonal bonding lines 18,19,20,21 ensures that no rice is trapped in the corners 23,24,25,26 and provides further cool areas that can be grasped during emptying of the pouch.

Referring to FIGS. 5-8, this embodiment 50 of the pouch according to the invention is generally similar to that of FIGS. 1-4. It comprises a pouch body 52, front and back faces 78,80, first top and bottom end seals 53,55 and side edges 54,56 and a pleat in the second side edge 54 only similar to those of FIGS. 1-4 that will not be described further. The embodiment of FIGS. 5-8 differs from that of FIGS. 1-4 in that the second top and bottom lines of sealing 58 each consist of a first portion 60 extending parallel to the first top and bottom lines of sealing 53,55 to an intermediate position, where they merge with the oblique seals 62 forming the corners of the pleated side. The parallel portions 53,55 do not extend all the way across the pouch, whereby the pouch can adopt a more expanded configuration than the pouch of FIGS. 1-4 when it is filled with cooked rice, thereby improving the stability of the pouch when it is standing on the pleated edge and allowing better drainage of water from the pouch.

A further feature of the pouch of FIGS. 5-8 is the construction of the longitudinal lap seal and the handle, as shown in more detail in FIG. 7. The tubular body 52 of the pouch is formed as before by folding over a single sheet of material and sealing opposed ends of the sheet with a longitudinal lap seal 70, whereby a flap 72 extends on the outside of the body 52 proximate and parallel to the side of the body opposite the pleated side such that the distal edge 75 of the flap substantially coincides with the side edge 56 of the body opposite the pleated side edge. The ends of the flap are bonded to the body by the transverse lines of sealing 53,55,60. A distal end of this flap is cut along a longitudinal line 73 parallel and spaced about 1.5 cm from the distal edge 75 to form the handle 74 that is bonded to the body at its ends by the transverse lines of sealing 53,55,60. In this way the handle can be made from the same sheet of material as the pouch body, as described further below.

The boil-in-bag rice pouch can be made using a modified vertical form/fill/seal process. A continuous web of thermoplastic material passes through an accumulator and then over resilient roller. A perforating roller presses into the resilient roller through the web and thereby forms perforations in the continuous web in order to make it water-permeable. Specifically, the perforating roller is provided on its surface with projections in the shape of triangular pyramids that pierce the continuous web forming so-called "star-punctures" in a 9 mm×9 mm square grid over substantially the whole of the web. The star punctures provide water permeability, but are spaced too far apart to provide easy tearing of the web material.

The web is then wrapped around a filling tube, and the tube is sealed at the bottom using a suitably shaped bottom heat sealing jaw or jaws to provide the bottom transverse heat seals. The pleat is formed by inserting a suitably shaped plate between the jaws on one side of the pouch. The plate may be inserted in reciprocating fashion, whereby it is withdrawn from the jaws between sealing operations so as not to interfere with filling The pouch then undergoes conventional vertical filling and sealing at the top in similar fashion to the bottom seal to produce the boil-in-bag rice pouch. Successive pouches are detached using a suitably shaped hot wire, hot knife or die cutter to form the nips.

Accordingly, it can be seen that the improved boil-in-bag pouches according to the present invention are easy to make, requiring only a slight modification of existing manufacturing processes.

The above embodiments of the present invention have been described by way of example only. Many other embodiments falling within the scope of the accompanying claims will be apparent to the skilled reader.

All patent documents referred to herein are incorporated in their entirety.

The invention claimed is:

1. A boil-in-bag pouch containing a foodstuff, wherein said pouch is in the form of an enclosed body having a front face, a back face, a top end, a bottom end, and first and second sides extending between said top and bottom ends, said pouch comprising:

a) a single sheet of flexible sheet material having first and second opposed edges, wherein said sheet is folded along said first side and said second side to define said front and back faces, wherein opposed edges of said sheet are bonded by a longitudinal seal extending from said top end to said bottom end of said pouch;

b) one or more diagonal lines of bonding are between layers of the sheet material and the diagonal lines of bonding extend obliquely from an intermediate region of the top and/or bottom of the pouch to an edge of the pouch, the said diagonal lines of bonding define two corners, respectively adjoining the top and bottom of said only one side edge of the pouch, from which the contents of the pouch are substantially excluded;

(c) each of said top and bottom ends comprising a first transverse seal between said front and back sheets extending substantially completely across said end; and a second transverse seal between said front and back sheets spaced inwardly from said first transverse seal and extending substantially parallel to said first seal from said first side to an intermediate position, where it joins to said diagonal lines of bonding but does not extend further parallel to said first transverse seal beyond said intermediate position, d) a pleat extending from the bottom second transverse seal to the top second transverse seal along only one side of said body wherein the pleat comprises a first strip of the sheet material folded inwardly towards the front face of the pouch along said only one side of the pouch and a second strip of the material folded inwardly towards the back face of the pouch along said only one side of the pouch, said first and second strips meeting along a fold line located internally of said front and back faces, and respective top and bottom ends of said first and second strips being bonded in face to face relationship with said front and back faces, respectively, at said top and bottom transverse seals, and wherein said diagonal lines of bonding are formed between the first strip and the front face of the pouch and between the second strip and the back face of the pouch adjacent to each of said first and second ends, but said diagonal lines of bonding are not formed between the first and second strips.

2. The boil-in-bag pouch according to claim 1, wherein one or more tear starts are in the top and/or bottom end of the pouch, said tear starts being located proximate to said first side of the pouch opposite the pleated side.

3. The boil-in-bag pouch according to claim 1, wherein one or more lines of weakness extend substantially from the top end to the bottom end of the pouch, said lines of weakness being located proximate to said first side of the pouch opposite the pleated side.

4. The boil-in-bag pouch according to claim 1, wherein a handle is attached to the pouch body for suspending said pouch with the said second side lowermost.

5. The boil-in-bag pouch according to claim 4, wherein said handle is formed by a strip of sheet material extending between the top and bottom transverse seals and bonded to the pouch body at the top and bottom transverse seals.

6. The boil-in-bag pouch according to claim 5, wherein said longitudinal seal between opposed edges of said sheet material is a lap seal whereby a longitudinal flap of said sheet material extends on the outside of the pouch body from the top to the bottom of said body and bonded to said front and back faces at said top and bottom transverse seals, and a longitudinal cut extends along at least a portion of said flap whereby said handle is formed by a distal portion of said flap.

7. The boil-in-bag pouch according to claim 1, wherein said body is formed from water-permeable sheet material, and said body contains a rehydratable foodstuff selected from the group consisting of cereal grains, pasta and beans.

8. The boil-in-bag pouch according to claim 1, wherein said pleat comprises a first strip of the sheet material folded inwardly towards the front face of the pouch along said only one side of the pouch and a second strip of the material folded inwardly towards the back face of the pouch along said only one side of the pouch, said first and second strips meeting along a fold line located internally of said front and back faces, and respective top and bottom ends of said first and second strips being bonded in face to face relationship with said front and back faces, respectively, at said top and bottom transverse seals.

9. The boil-in-bag pouch according to claim 8, wherein the width of said folded regions, corresponding to the maximum depth of the pleat formed in the said only one side of the pouch, is from about 2 cm to about 6 cm.

10. The boil-in-bag pouch according to claim 1, wherein the top and bottom transverse seals provide end flaps on the pouch from which the contents of the pouch are substantially excluded, wherein the end flaps have a minimum width (measured in the longitudinal direction of the pouch) of from about 1 cm to about 4 cm.

* * * * *